US012545483B1

(12) United States Patent
Vitello et al.

(10) Patent No.: US 12,545,483 B1
(45) Date of Patent: Feb. 10, 2026

(54) SYSTEMS AND METHODS FOR FILLING AND VENTING DROPPER BOTTLES

(71) Applicants: Jonathan Vitello, Fort Lauderdale, FL (US); Peter Lehel, Boca Raton, FL (US); Patrick Vitello, Pompano Beach, FL (US)

(72) Inventors: Jonathan Vitello, Fort Lauderdale, FL (US); Peter Lehel, Boca Raton, FL (US); Patrick Vitello, Pompano Beach, FL (US)

(73) Assignee: MEDICAL DEVICE ENGINEERING, LLC, Pompano Beach, FL (US)

( * ) Notice: Subject to any disclaimer, the term of this patent is extended or adjusted under 35 U.S.C. 154(b) by 96 days.

(21) Appl. No.: 18/138,598

(22) Filed: Apr. 24, 2023

Related U.S. Application Data

(60) Provisional application No. 63/333,969, filed on Apr. 22, 2022, provisional application No. 63/333,985, filed on Apr. 22, 2022.

(51) Int. Cl.
*B65D 47/32* (2006.01)
*B65D 47/18* (2006.01)

(52) U.S. Cl.
CPC ..... *B65D 47/32* (2013.01); *B65D 47/18* (2013.01)

(58) Field of Classification Search
CPC ..... B65D 47/32; B65D 47/18
USPC ..... 222/420; 141/113
See application file for complete search history.

(56) References Cited

U.S. PATENT DOCUMENTS

| | | | |
|---|---|---|---|
| 722,943 | A | 3/1903 | Chappell |
| 732,662 | A | 6/1903 | Smith |
| 1,678,991 | A | 7/1928 | Marschalek |
| 1,970,631 | A | 8/1934 | Sherman |
| 2,186,888 | A | 1/1940 | Tullar et al. |
| 2,277,936 | A | 3/1942 | Rosenblatt |
| 2,459,304 | A | 1/1949 | Blank |
| 2,477,598 | A | 8/1949 | Hain |
| 2,734,665 | A | 2/1956 | Flamm |
| 2,739,590 | A | 3/1956 | Yochem |
| 2,811,283 | A | 10/1957 | Bowen |
| 2,823,674 | A | 2/1958 | Yochem |
| 2,834,346 | A | 5/1958 | Adams |

(Continued)

FOREIGN PATENT DOCUMENTS

| | | |
|---|---|---|
| CN | 110589435 | 12/2019 |
| DE | 202008018507 | 2/2015 |

(Continued)

OTHER PUBLICATIONS

Arai Tsugio, Pilfering Proof Cap, JPH082544—Jan. 9, 1996.

*Primary Examiner* — Paul R Durand
*Assistant Examiner* — Michael J. Melaragno
(74) *Attorney, Agent, or Firm* — Malloy & Malloy, P.L.; Jennie S. Malloy

(57) ABSTRACT

The present invention is directed to systems and methods that permit dropper bottles to be filled without removing the dropper spout from the body of the bottle. As such, dropper bottles having integrated spouts can be filled after manufacture of the bottle, which facilitates the aseptic preparation of compounded solutions. In some embodiments, the inventive bottle includes a fill valve on the base and is vented through the nozzle. In other embodiments, the bottle is both filled and vented via the nozzle.

5 Claims, 3 Drawing Sheets

(56) References Cited

U.S. PATENT DOCUMENTS 2,875,761 A 3/1959 Helmer et al.
2,888,015 A 5/1959 Hunt
2,952,255 A 9/1960 Hein, Jr.
3,122,280 A 2/1964 Goda
3,180,532 A 4/1965 Michel
3,245,567 A 4/1966 Knight
3,301,256 A 1/1967 Cowley
3,323,798 A 6/1967 Miller
3,364,890 A 1/1968 Andersen
3,368,673 A 2/1968 Johnson
3,489,268 A 1/1970 Meierhoefer
3,568,673 A 3/1971 Cowley
3,574,306 A 4/1971 Alden
3,598,120 A 8/1971 Mass
3,610,241 A 10/1971 LeMarie
3,674,181 A 7/1972 Marks et al.
3,700,215 A 10/1972 Hardman et al.
3,706,307 A 12/1972 Hasson
3,710,922 A 1/1973 Lanphere et al.
3,712,749 A 1/1973 Roberts
3,726,445 A 4/1973 Ostrowsky et al.
3,730,325 A 5/1973 Goodwin
3,747,751 A 7/1973 Miller et al.
3,850,329 A 11/1974 Robinson
3,872,867 A 3/1975 Killinger
3,904,033 A 9/1975 Haerr
3,905,375 A 9/1975 Toyama
3,937,211 A 2/1976 Merten
3,987,930 A 10/1976 Fuson
4,005,739 A 2/1977 Winchell
4,027,669 A 6/1977 Johnston et al.
4,043,334 A 8/1977 Brown et al.
4,046,145 A 9/1977 Choksi et al.
4,068,696 A 1/1978 Winchell
4,085,845 A 4/1978 Perfect
4,106,621 A 8/1978 Sorenson
4,216,585 A 8/1980 Hatter
4,216,872 A 8/1980 Bean
4,220,151 A 9/1980 Whitney
4,244,366 A 1/1981 Raines
4,252,122 A 2/1981 Halvorsen
4,271,972 A 6/1981 Thor
4,286,591 A 9/1981 Raines
4,286,640 A 9/1981 Knox et al.
4,313,539 A 2/1982 Raines
4,369,781 A 1/1983 Gilson et al.
4,420,085 A 12/1983 Wilson et al.
4,430,077 A 2/1984 Mittleman et al.
4,433,790 A 2/1984 Gibson
4,457,445 A 7/1984 Hanks et al.
4,482,071 A 11/1984 Ishiwatari
D277,783 S 2/1985 Beck
4,520,942 A 6/1985 Dwinell
4,521,237 A 6/1985 Logothetis
4,530,437 A 7/1985 Gray et al.
4,530,697 A 7/1985 Kuhlemann et al.
4,558,554 A 12/1985 Herbert
4,571,242 A 2/1986 Klien et al.
4,589,171 A 5/1986 McGill
4,608,646 A 8/1986 Goodrich et al.
4,664,259 A 5/1987 Landis
4,667,837 A 5/1987 Vitello et al.
4,676,530 A 6/1987 Nordgren et al.
4,693,707 A 9/1987 Dye
4,726,483 A 2/1988 Drozd
4,735,617 A 4/1988 Nelson et al.
4,742,910 A 5/1988 Staebler
4,743,229 A 5/1988 Chu
4,743,231 A 5/1988 Kay et al.
4,744,455 A 5/1988 Dragotta et al.
4,753,345 A 6/1988 Goodsir et al.
4,760,847 A 8/1988 Vaillancourt
4,784,493 A 11/1988 Turcheck, Jr. et al.
4,813,564 A 3/1989 Cooper et al.
4,819,784 A 4/1989 Sticht
4,832,695 A 5/1989 Rosenberg et al.
4,834,706 A 5/1989 Beck et al.
4,842,592 A 6/1989 Caggiani et al.
4,844,906 A 7/1989 Hermelin et al.
4,863,451 A 9/1989 Marder
4,906,231 A 3/1990 Young
4,919,285 A 4/1990 Roof et al.
4,936,445 A 6/1990 Grabenkort
5,007,535 A 4/1991 Meseke et al.
5,009,323 A 4/1991 Montgomery et al.
5,024,323 A 6/1991 Bolton
5,049,129 A 9/1991 Zdeb et al.
5,057,093 A 10/1991 Clegg et al.
D323,392 S 1/1992 Bryne
5,078,696 A 1/1992 Nedbaluk
5,085,332 A 2/1992 Gettig et al.
5,090,564 A 2/1992 Chimienti
5,119,975 A * 6/1992 Jemielita ..... B65D 47/18
222/479
5,133,454 A 7/1992 Hammer
5,135,496 A 8/1992 Vetter et al.
5,148,652 A 9/1992 Herzog
5,163,922 A 11/1992 McElveen, Jr. et al.
5,165,560 A 11/1992 Ennis, III et al.
5,230,429 A 7/1993 Etheredge, III
5,236,077 A 8/1993 Hoppmann et al.
5,267,983 A 12/1993 Oilschlager et al.
5,292,308 A 3/1994 Ryan
5,293,993 A 3/1994 Yates, Jr. et al.
5,295,599 A 3/1994 Smith
5,312,367 A 5/1994 Nathan
5,312,368 A 5/1994 Haynes
5,316,163 A 5/1994 von Schuckmann
5,328,466 A 7/1994 Denmark
5,328,474 A 7/1994 Raines
5,332,113 A 7/1994 Kusler, III et al.
5,356,380 A 10/1994 Hoekwater et al.
5,370,226 A 12/1994 Gollobin et al.
5,380,295 A 1/1995 Vacca
5,402,887 A 4/1995 Shillington
5,405,339 A 4/1995 Kohnen et al.
5,456,668 A 10/1995 Ogle, II
5,458,580 A 10/1995 Hajishoreh
5,468,224 A 11/1995 Souryal
5,474,178 A 12/1995 DiViesti et al.
5,505,705 A 4/1996 Galpin et al.
5,531,695 A 7/1996 Swisher
5,540,324 A 7/1996 Knapp
5,540,666 A 7/1996 Barta et al.
5,549,571 A 8/1996 Sak
5,558,648 A 9/1996 Shields
5,584,817 A 12/1996 van den Haak
5,588,239 A 12/1996 Anderson
5,611,445 A 3/1997 Kano et al.
5,617,954 A 4/1997 Kato et al.
5,624,402 A 4/1997 Imbert
5,662,233 A 9/1997 Reid
5,674,209 A 10/1997 Yarger
5,695,470 A 12/1997 Roussigne et al.
5,699,913 A 12/1997 Richardson
5,700,247 A 12/1997 Grimard et al.
5,702,374 A 12/1997 Johnson
5,706,985 A * 1/1998 Feer ..... B67D 3/0032
222/469
5,711,443 A 1/1998 Bennett
5,713,485 A 2/1998 Liff et al.
5,776,124 A 7/1998 Wald
5,785,691 A 7/1998 Vetter et al.
5,797,885 A 8/1998 Rubin
5,807,343 A 9/1998 Tucker et al.
5,829,589 A 11/1998 Nguyen et al.
D402,766 S 12/1998 Smith et al.
5,842,567 A 12/1998 Rowe et al.
5,876,381 A 3/1999 Pond et al.
5,883,806 A 3/1999 Meador et al.
5,884,457 A 3/1999 Ortiz et al.
5,901,866 A 5/1999 Storar
5,902,269 A 5/1999 Jentzen
5,926,922 A 7/1999 Stottle

(56) References Cited

U.S. PATENT DOCUMENTS 5,951,522 A 9/1999 Rosato et al.
5,951,525 A 9/1999 Thorne et al.
5,954,203 A 9/1999 Marconi
5,954,657 A 9/1999 Rados
5,957,166 A 9/1999 Safabash
5,957,314 A 9/1999 Nishida et al.
5,963,136 A 10/1999 O'Brien
5,983,596 A 11/1999 Corniani et al.
5,989,227 A 11/1999 Vetter et al.
5,993,437 A 11/1999 Raoz
6,000,548 A 12/1999 Tsals
D419,671 S 1/2000 Jansen
6,021,824 A 2/2000 Larsen et al.
6,027,482 A 2/2000 Imbert
6,068,614 A 5/2000 Kimber et al.
D430,293 S 8/2000 Jansen
6,112,951 A 9/2000 Mueller
D431,864 S 10/2000 Jansen
6,126,640 A 10/2000 Tucker et al.
6,190,364 B1 2/2001 Imbert
6,193,688 B1 2/2001 Balestracci et al.
6,196,593 B1 3/2001 Petrick et al.
6,196,998 B1 3/2001 Jansen et al.
6,216,885 B1 4/2001 Guillaume
6,235,376 B1 5/2001 Miyazaki et al.
6,279,746 B1 8/2001 Hussaini et al.
6,280,418 B1 8/2001 Reinhard et al.
6,287,671 B1 9/2001 Bright et al.
6,322,543 B1 11/2001 Singh et al.
6,325,227 B1 12/2001 Ekkert
6,338,200 B1 1/2002 Baxa et al.
6,358,241 B1 3/2002 Shapeton et al.
6,375,640 B1 4/2002 Teraoka
6,394,983 B1 5/2002 Mayoral et al.
6,439,276 B1 8/2002 Wood et al.
6,485,460 B2 11/2002 Eakins et al.
6,488,666 B1 12/2002 Geist
6,491,665 B1 12/2002 Vetter et al.
6,500,155 B2 12/2002 Sasso
6,520,935 B1 2/2003 Jansen et al.
6,540,697 B2 4/2003 Chen
6,565,529 B1 5/2003 Kimber et al.
6,581,792 B1 6/2003 Limanjaya
6,585,691 B1 7/2003 Vitello
6,592,251 B2 7/2003 Edwards et al.
6,666,852 B2 12/2003 Niedospial, Jr.
6,682,798 B1 1/2004 Kiraly
6,726,652 B2 4/2004 Eakins et al.
6,726,672 B1 4/2004 Hanly et al.
6,764,469 B2 7/2004 Broselow
6,796,586 B2 9/2004 Werth
6,821,268 B2 11/2004 Balestracci
D501,549 S 2/2005 McAllister et al.
6,921,383 B2 7/2005 Vitello
6,935,560 B2 8/2005 Andreasson et al.
6,942,643 B2 9/2005 Eakins et al.
6,961,638 B2 11/2005 Ouellette
6,991,126 B2 1/2006 Jackel
7,036,661 B2 5/2006 Anthony et al.
7,055,273 B2 6/2006 Roshkoff
7,100,771 B2 9/2006 Massengale et al.
7,125,397 B2 10/2006 Woehr et al.
7,141,286 B1 11/2006 Kessler et al.
7,175,081 B2 2/2007 Andreasson et al.
7,182,256 B2 2/2007 Andreasson et al.
7,232,066 B2 6/2007 Anderasson et al.
7,240,926 B2 7/2007 Dalle et al.
7,258,222 B2 8/2007 Sala et al.
7,299,981 B2 11/2007 Hickle et al.
7,367,964 B2 5/2008 Heinz et al.
7,374,555 B2 5/2008 Heinz et al.
7,404,500 B2 7/2008 Marteau et al.
7,410,803 B2 8/2008 Nollert et al.
7,425,208 B1 9/2008 Vitello
7,437,972 B2 10/2008 Yeager
7,438,704 B1 * 10/2008 Kawashima ..... B65D 1/08 215/381
D581,046 S 11/2008 Sudo
D581,047 S 11/2008 Koshidaka
D581,049 S 11/2008 Sudo
7,482,166 B2 1/2009 Nollert et al.
D589,612 S 3/2009 Sudo
7,497,330 B2 3/2009 Anthony et al.
7,503,453 B2 3/2009 Cronin et al.
7,588,563 B2 9/2009 Guala
7,594,681 B2 9/2009 DeCarlo
7,608,057 B2 10/2009 Woehr et al.
7,611,487 B2 11/2009 Woehr et al.
7,632,244 B2 12/2009 Buehler et al.
D608,900 S 1/2010 Giraud et al.
7,641,636 B2 1/2010 Moesli et al.
D612,939 S 3/2010 Boone, III et al.
7,681,606 B2 3/2010 Khan et al.
7,698,180 B2 4/2010 Fago et al.
7,708,035 B2 * 5/2010 Windmiller ..... B65D 47/248 220/709
7,735,664 B1 6/2010 Peters et al.
7,748,892 B2 7/2010 McCoy
7,762,988 B1 7/2010 Vitello
7,766,919 B2 8/2010 Delmotte
7,802,313 B2 9/2010 Czajka
7,886,908 B2 2/2011 Farrar et al.
7,918,830 B2 4/2011 Langan et al.
7,922,213 B2 4/2011 Werth
7,988,004 B1 8/2011 Marret et al.
8,034,041 B2 10/2011 Domkowski et al.
8,079,518 B2 12/2011 Turner et al.
8,091,727 B2 1/2012 Domkowwski
8,118,788 B2 2/2012 Frezza
8,120,484 B2 2/2012 Chisholm
8,128,605 B2 3/2012 Masi et al.
8,137,324 B2 3/2012 Bobst
8,140,349 B2 3/2012 Hanson et al.
8,151,970 B2 4/2012 McDonald et al.
8,231,585 B2 7/2012 Heinz et al.
8,252,247 B2 8/2012 Ferlic
8,257,286 B2 9/2012 Meyer et al.
8,328,082 B1 12/2012 Bochenko et al.
8,348,895 B1 1/2013 Vitello
8,353,869 B2 1/2013 Ranalletta et al.
8,413,410 B2 4/2013 Ulm et al.
8,413,811 B1 4/2013 Arendt
8,443,999 B1 5/2013 Reinders
D684,057 S 6/2013 Kwon
8,512,277 B2 8/2013 Del Vecchio
8,528,757 B2 9/2013 Bisio
8,556,074 B2 10/2013 Turner et al.
8,579,116 B2 11/2013 Pether et al.
8,591,462 B1 11/2013 Vitello
8,597,255 B2 12/2013 Emmott et al.
8,597,271 B2 12/2013 Langan et al.
8,616,413 B2 12/2013 Koyama
D701,304 S 3/2014 Lair et al.
8,672,902 B2 3/2014 Ruan et al.
8,702,674 B2 4/2014 Bochenko
8,777,910 B2 7/2014 Bauss et al.
8,777,930 B2 7/2014 Swisher et al.
8,813,944 B2 8/2014 Tanner
8,852,561 B2 10/2014 Wagner et al.
8,864,021 B1 10/2014 Vitello
8,864,707 B1 10/2014 Vitello
8,864,708 B1 10/2014 Vitello
8,911,424 B2 12/2014 Weadock et al.
8,945,082 B2 2/2015 Geiger et al.
8,978,909 B2 3/2015 Kakutani et al.
8,985,305 B2 3/2015 Wong et al.
9,016,473 B2 4/2015 Tamarindo
9,027,769 B2 5/2015 Willows et al.
9,082,157 B2 7/2015 Gibson
9,095,667 B2 8/2015 Schuckman
9,101,534 B2 8/2015 Bochenko
D738,495 S 9/2015 Strong et al.
9,125,976 B2 9/2015 Uber, III et al.
D743,019 S 11/2015 Schultz

(56) References Cited

U.S. PATENT DOCUMENTS 9,192,443 B2 11/2015 Tennican
9,199,042 B2 12/2015 Farrar et al.
9,199,749 B1 12/2015 Vitello et al.
9,220,486 B2 12/2015 Schweiss et al.
9,220,577 B2 12/2015 Jessop et al.
9,227,019 B2 1/2016 Swift et al.
D750,228 S 2/2016 Strong et al.
9,272,099 B2 3/2016 Limaye et al.
9,311,592 B1 4/2016 Vitello et al.
D756,777 S 5/2016 Berge et al.
9,336,669 B2 5/2016 Bowden et al.
D759,486 S 6/2016 Ingram et al.
D760,384 S 6/2016 Niunoya et al.
D760,902 S 7/2016 Persson
9,402,967 B1 8/2016 Vitello
9,427,715 B2 8/2016 Palazzolo et al.
9,433,768 B2 9/2016 Tekeste et al.
9,463,310 B1 10/2016 Vitello
D773,043 S 11/2016 Ingram et al.
9,480,801 B2 11/2016 Schiller et al.
D777,903 S 1/2017 Schultz
9,662,456 B2 5/2017 Woehr
D789,529 S 6/2017 Davis et al.
9,687,249 B2 6/2017 Hanlon et al.
9,694,948 B1 7/2017 Pakhomov et al.
9,744,304 B2 8/2017 Swift et al.
D797,928 S 9/2017 Davis et al.
D797,929 S 9/2017 Davis et al.
9,764,098 B2 9/2017 Hund et al.
9,821,152 B1 11/2017 Vitello et al.
D806,241 S 12/2017 Swinney et al.
D807,503 S 1/2018 Davis et al.
9,855,191 B1 1/2018 Vitello et al.
D815,945 S 4/2018 Fischer
9,987,438 B2 6/2018 Stillson
D825,746 S 8/2018 Davis et al.
10,039,913 B2 8/2018 Yeh et al.
D831,201 S 10/2018 Holtz et al.
D834,187 S 11/2018 Ryan
10,124,122 B2 11/2018 Zenker
10,166,343 B1 1/2019 Hunt et al.
10,166,347 B1 1/2019 Vitello
10,183,129 B1 1/2019 Vitello
10,207,099 B1 2/2019 Vitello
10,207,835 B2 2/2019 Wilhelm et al.
D842,464 S 3/2019 Davis et al.
D847,373 S 4/2019 Hurwit et al.
10,293,987 B2 5/2019 Sattig et al.
10,300,263 B1 5/2019 Hunt
10,307,548 B1 6/2019 Hunt et al.
10,315,024 B1 6/2019 Vitello et al.
10,315,808 B2 6/2019 Taylor et al.
10,376,655 B2 8/2019 Pupke et al.
D859,125 S 9/2019 Weagle et al.
10,478,262 B2 11/2019 Niese et al.
10,555,872 B1 2/2020 Thorne
10,618,711 B2 4/2020 Weir
10,695,490 B2 6/2020 Perazzo et al.
10,758,684 B1 9/2020 Vitello et al.
10,759,611 B1 9/2020 Kalm
10,773,067 B2 9/2020 Davis et al.
10,800,556 B2 10/2020 Thorne et al.
D903,865 S 12/2020 Banik et al.
10,888,672 B1 1/2021 Vitello
10,898,659 B1 1/2021 Vitello et al.
10,912,898 B1 2/2021 Vitello et al.
10,933,202 B1 3/2021 Banik
10,940,087 B2 * 3/2021 Thorne ..... A61J 1/16
10,953,162 B1 3/2021 Hunt et al.
11,040,149 B1 6/2021 Banik
11,040,154 B1 6/2021 Vitello et al.
11,065,181 B2 7/2021 Davis et al.
11,097,071 B1 8/2021 Hunt et al.
11,168,818 B2 11/2021 Fangrow
11,254,514 B2 2/2022 Vienot et al.
11,278,681 B1 3/2022 Banik et al.
D948,713 S 4/2022 Banik
11,357,588 B1 6/2022 Vitello et al.
11,413,406 B1 8/2022 Vitello et al.
11,426,328 B1 8/2022 Ollmann et al.
11,471,610 B1 10/2022 Banik et al.
11,523,970 B1 12/2022 Vitello et al.
11,541,180 B1 1/2023 Vitello et al.
11,690,994 B1 7/2023 Banik et al.
11,697,527 B1 7/2023 Hendren et al.
11,779,520 B1 10/2023 Vitello
11,793,987 B1 10/2023 Vitello et al.
11,850,210 B2 12/2023 Dadachanji et al.
11,857,751 B1 1/2024 Vitello
11,872,187 B1 1/2024 Vitello et al.
11,904,149 B1 2/2024 Vitello et al.
11,911,339 B1 2/2024 Lehel et al.
12,070,591 B1 8/2024 Vitello
12,172,803 B1 12/2024 Vitello et al.
12,195,241 B1 1/2025 Vitello et al.
12,201,230 B2 * 1/2025 Bell ..... A47G 19/2272
12,383,463 B1 8/2025 Vitello et al.
12,478,449 B1 11/2025 Vitello et al.
2001/0003150 A1 6/2001 Imbert
2001/0034506 A1 10/2001 Hirschman et al.
2001/0056258 A1 12/2001 Evans
2002/0007147 A1 1/2002 Capes et al.
2002/0023409 A1 2/2002 Py
2002/0046962 A1 4/2002 Vallans et al.
2002/0079281 A1 6/2002 Hierzer et al.
2002/0097396 A1 7/2002 Schafer
2002/0099334 A1 7/2002 Hanson et al.
2002/0101656 A1 8/2002 Blumenthal et al.
2002/0104770 A1 8/2002 Shapeton et al.
2002/0133119 A1 9/2002 Eakins et al.
2002/0188259 A1 12/2002 Hickle et al.
2003/0041560 A1 3/2003 Kemnitz
2003/0055685 A1 3/2003 Cobb et al.
2003/0146617 A1 8/2003 Franko, Sr.
2003/0183547 A1 10/2003 Heyman
2003/0187403 A1 10/2003 Balestracci
2004/0008123 A1 1/2004 Carrender et al.
2004/0011623 A1 1/2004 Sala
2004/0064095 A1 4/2004 Vitello
2004/0116858 A1 6/2004 Heinz et al.
2004/0129738 A1 * 7/2004 Stukas ..... B65D 47/123 222/546
2004/0173563 A1 9/2004 Kim et al.
2004/0186437 A1 9/2004 Frenette et al.
2004/0225258 A1 11/2004 Balestracci
2005/0146081 A1 7/2005 MacLean et al.
2005/0148941 A1 7/2005 Farrar et al.
2005/0209555 A1 9/2005 Middleton et al.
2006/0049948 A1 3/2006 Chen et al.
2006/0084925 A1 4/2006 Ramsahoye
2006/0089601 A1 4/2006 Dionigi
2006/0169611 A1 8/2006 Prindle
2006/0173415 A1 8/2006 Cummins
2006/0189933 A1 8/2006 Alheidt et al.
2007/0060898 A1 3/2007 Shaughnessy et al.
2007/0106234 A1 5/2007 Klein
2007/0142786 A1 6/2007 Lampropoulos et al.
2007/0191690 A1 8/2007 Hasse et al.
2007/0219503 A1 9/2007 Loop et al.
2007/0257111 A1 11/2007 Ortenzi
2008/0068178 A1 3/2008 Meyer
2008/0078146 A1 4/2008 Cirio
2008/0097310 A1 4/2008 Buehler et al.
2008/0106388 A1 5/2008 Knight
2008/0140020 A1 6/2008 Shirley
2008/0243088 A1 10/2008 Evans
2008/0302711 A1 * 12/2008 Windmiller ..... B67D 1/0456 210/137
2008/0303267 A1 12/2008 Schnell et al.
2008/0306443 A1 12/2008 Neer
2009/0008356 A1 * 1/2009 Gadzic ..... B65D 83/771 215/310
2009/0084804 A1 4/2009 Caspary et al.
2009/0099552 A1 4/2009 Levy et al.

(56) References Cited

U.S. PATENT DOCUMENTS

2009/0149815 A1 6/2009 Kiel et al.
2009/0166311 A1 7/2009 Claessens
2009/0212954 A1 8/2009 Adstedt et al.
2009/0326481 A1 12/2009 Swisher et al.
2010/0050351 A1 3/2010 Colantonio et al.
2010/0051491 A1 3/2010 Lampropoulos et al.
2010/0084403 A1 4/2010 Popish et al.
2010/0089862 A1 4/2010 Schmitt
2010/0126894 A1 5/2010 Koukol et al.
2010/0179822 A1 7/2010 Reppas
2010/0211016 A1 8/2010 Palmer-Felgate
2010/0228226 A1 9/2010 Nielsen
2010/0252564 A1 10/2010 Martinez et al.
2010/0283238 A1 11/2010 Deighan et al.
2010/0307108 A1 12/2010 Sink et al.
2011/0009836 A1* 1/2011 Chebli ..... B65D 47/18
604/298
2011/0044850 A1 2/2011 Solomon et al.
2011/0046550 A1 2/2011 Schiller et al.
2011/0046603 A1 2/2011 Felsovalyi et al.
2012/0064515 A2 3/2012 Knapp et al.
2012/0096957 A1 4/2012 Ochman
2012/0110950 A1 5/2012 Schraudolph
2013/0018356 A1 1/2013 Prince et al.
2013/0018536 A1 1/2013 Prince et al.
2013/0037383 A1 2/2013 Iwasa et al.
2013/0056130 A1 3/2013 Alpert et al.
2013/0088354 A1 4/2013 Thomas
2013/0145725 A1 6/2013 Bianco et al.
2013/0237949 A1 9/2013 Miller
2013/0269592 A1 10/2013 Heacock et al.
2014/0000781 A1 1/2014 Franko, Jr.
2014/0034536 A1 2/2014 Reinhardt et al.
2014/0069202 A1 3/2014 Fisk
2014/0069829 A1 3/2014 Evans
2014/0076840 A1 3/2014 Graux et al.
2014/0135738 A1 5/2014 Panian
2014/0155868 A1 6/2014 Nelson et al.
2014/0163465 A1 6/2014 Bartlett, II et al.
2014/0257843 A1 9/2014 Adler et al.
2014/0319141 A1* 10/2014 Stratis ..... A61J 1/1418
220/277
2014/0326727 A1 11/2014 Jouin et al.
2014/0353196 A1 12/2014 Key
2014/0358078 A1 12/2014 Fischer et al.
2015/0013811 A1 1/2015 Carrel et al.
2015/0048045 A1 2/2015 Miceli et al.
2015/0112296 A1 4/2015 Ishiwata et al.
2015/0136632 A1 5/2015 Moir et al.
2015/0182686 A1 7/2015 Okihara
2015/0191633 A1 7/2015 De Boer et al.
2015/0246185 A1 9/2015 Heinz
2015/0251820 A1 9/2015 Glaser et al.
2015/0298414 A1 10/2015 Dittmer et al.
2015/0302232 A1 10/2015 Strassburger et al.
2015/0305982 A1 10/2015 Bochenko
2015/0310771 A1 10/2015 Atkinson et al.
2016/0067144 A1 3/2016 Chang
2016/0067422 A1 3/2016 Davis et al.
2016/0090456 A1 3/2016 Ishimaru et al.
2016/0136352 A1 5/2016 Smith et al.
2016/0144119 A1 5/2016 Limaye et al.
2016/0158110 A1 6/2016 Swisher et al.
2016/0158449 A1 6/2016 Limaye et al.
2016/0176550 A1 6/2016 Viitello et al.
2016/0194121 A1 7/2016 Ogawa et al.
2016/0250420 A1 9/2016 Maritan et al.
2016/0279032 A1 9/2016 Davis
2016/0328586 A1 11/2016 Bowden et al.
2016/0361235 A1 12/2016 Swisher
2016/0367439 A1 12/2016 Davis et al.
2017/0007771 A1 1/2017 Duinat et al.
2017/0014310 A1 1/2017 Hyun et al.
2017/0124289 A1 5/2017 Hasan et al.
2017/0173321 A1 6/2017 Davis et al.
2017/0203086 A1 7/2017 Davis
2017/0225843 A1 8/2017 Glaser et al.
2017/0239141 A1 8/2017 Davis et al.
2017/0297781 A1 10/2017 Kawamura
2017/0319438 A1 11/2017 Davis et al.
2017/0328758 A1* 11/2017 Fuchs ..... G01F 11/44
2017/0349335 A1 12/2017 Sattig et al.
2017/0354792 A1 12/2017 Ward
2018/0001540 A1 1/2018 Byun
2018/0014998 A1 1/2018 Yuki et al.
2018/0064604 A1 3/2018 Drmanovic
2018/0078684 A1 3/2018 Peng et al.
2018/0089593 A1 3/2018 Patel et al.
2018/0098915 A1 4/2018 Rajagopal et al.
2018/0147115 A1 5/2018 Nishioka et al.
2018/0236177 A1 8/2018 Schraga
2018/0312305 A1 11/2018 Rognard
2019/0275313 A1 9/2019 Godin et al.
2019/0308006 A1 10/2019 Erekovcanski et al.
2019/0388626 A1 12/2019 Okihara
2021/0228445 A1 7/2021 Bouteloup et al.
2021/0244892 A1 8/2021 Maritan et al.
2022/0008645 A1 1/2022 Ukai et al.
2022/0024630 A1* 1/2022 Bohamed ..... A45F 3/16
2022/0257467 A1 8/2022 Yano et al.
2022/0296470 A1 9/2022 Wagner
2022/0339067 A1 10/2022 Christine et al.
2023/0036805 A1 2/2023 Rey

FOREIGN PATENT DOCUMENTS

DE 102020123373 3/2020
DE 102020123392 3/2022
DE 102020131870 6/2022
EP 0148116 7/1985
EP 269920 6/1988
EP 571980 12/1993
EP 2724977 4/2014
GB 486367 6/1938
JP 08002544 1/1996
JP 2014076618 5/2014
KR 101159987 6/2012
KR 101868822 6/2018
WO WO8607040 12/1986
WO WO9118801 12/1991
WO WO1992003348 3/1992
WO WO2008000279 1/2008
WO WO2017086607 5/2015

* cited by examiner

SYSTEMS AND METHODS FOR FILLING AND VENTING DROPPER BOTTLES

CLAIM OF PRIORITY

The present application claims priority under 35 U.S.C. Section 119 to U.S. Provisional application having Ser. No. 63/333,969, which was filed on Apr. 22, 2022, as well as U.S. Provisional application having Ser. No. 63/333,985, which was filed on Apr. 22, 2022, both of which are incorporated by reference herein in their entireties.

BACKGROUND OF THE INVENTION

Field of the Invention

The present invention pertains to dropper bottles having integrated filling and venting structure, allowing the dropper bottles to be filled without removing the nozzle from the bottle.

Description of the Related Art

Sterile ophthalmic compounding is currently widely used in 503B, 503A, eye institutes, and hospital pharmacy facilities worldwide. In addition to human drug compounding, eyedropper products can also apply to veterinary compounding. A typical ophthalmic drug dropper, when compounded, consists of a bottle, cap and spout which must be filled and assembled while maintaining aseptic technique. Aseptic technique requires strict procedures for preparing the drug in a sterile, Class 5 clean room environment under a laminar flow hood and avoiding touching component surfaces which can contact the drug. Since the bottle, spout and cap are separate components it makes the aseptic preparation extremely difficult. The most critical part is the spout which is in direct contact with the drug and this component typically must be put on the bottle after it has been filled without touching it.

Therefore, there is a need in the art to supply sterile, enclosed (in the case of a dropper bottle having a unitary dropper spout and body) or pre-assembled dropper bottles which can be filled by compounders without having to remove the spout from the body, thereby maintaining the sterile environment inside of the bottle.

This present invention eliminates the handling of multiple components by allowing the spout to be integrated into the bottle and/or preassembled and delivered to the compounder with a sterile interior.

SUMMARY OF THE INVENTION

Various embodiments of the present invention are disclosed herein, one aim of which is to provide a dropper bottle that can be filled without removing the nozzle from the body, thereby maintaining aseptic technique and a sterile bottle interior. In one embodiment, the invention permits the dropper bottle to be filled via the dropper spout by providing suitable vent structure in the bottle and/or nozzle. In an alternative embodiment, the bottle may be filled via a separate fill valve, which is preferably located on the base of the bottle.

In one embodiment, the invention includes a nozzle having a plurality of fluid pathways. In such an embodiment, the dropper spout of the nozzle may be at least partially segregated into a plurality of fluid pathways, including at least liquid pathway and an air vent. The liquid pathway is in communication with the dropper spout, allowing fluid communication between the interior of the bottle and the exterior of the bottle, such as for filling the bottle and for administering the contents. The vent includes a vent tube in fluid communication with an air outlet. The vent tube runs at least partially into the body of the bottle to help preclude liquid from pouring out of the air vent when the bottle is inverted. The air outlet can be disposed on the surface of the nozzle. In a preferred embodiment, the air outlet is separated from the dropper spout by a predetermined distance to avoid inadvertently filling the bottle through the vent. Otherwise, the air outlet can be at least partially shielded such that care need not be taken when filling the bottle, as liquid will be automatically diverted into the liquid pathway via the shield. The air outlet may also comprise a one-way valve.

In another embodiment, the invention includes a fill valve at the base of the bottle such that the bottle can be filled from the bottom. This allows the nozzle to operate as an air vent while the bottle is being filled. Alternatively, a dedicated vent (as discussed above) may also be included if desired. In such an embodiment, the fill valve may comprise any of a variety of one way valves such as a duck bill valve, a septum valve, a check valve, a ball valve, and the like. The exterior portion of the valve can also comprise any of a variety of standard fittings, such as a luer fitting, which facilitates filling the bottle via a syringe. Alternatively, a needleless connector may be used to fill the bottle from a repeater pump.

One alternative embodiment for a one-way valve includes a plug having a tab on one end and a sealing end on the other end of the plug. The sealing end is disposed inside of the bottle with the tab protruding from the exterior of the bottle via an aperture in the base of the bottle. Prior to filling, the plug is disposed in a substantially free floating orientation, which allows the bottle to be filled. Once filled, the tab can be pulled, and the plug seated in a substantially sealed orientation. The diameter of the sealing end should be larger than the aperture in the bottle, and may include a gasket or some other material to facilitate a substantially water tight seal.

The invention may also include a cap for the bottle which is designed to be partially installed prior to filling in order to allow air to escape during filling. Once the bottle is filled, the cap can be secured in a substantially water or air tight orientation, such as by a quarter turn of the cap. If desired, the cap may include any of a number of tamper evident features, such as breakaway tabs.

In all embodiments, any of a variety of filters and filter media may be incorporated into the bottle. By way of example, it may be desirable to include a filter membrane between the dropper spout and the body of the bottle. In certain embodiments, a filter having a filter distance of 0.4 microns may be desired. If a repeater pump is used to fill the bottle, it may be desirable to use a hydrophobic filter on the order of 12 microns in the pump itself.

The present invention is also directed to a method of filling a sealed dropper bottle, whether the bottle is unitary or preassembled. The method according to one embodiment can include providing an empty and sterile dropper bottle; providing a solution to be transferred to the dropper bottle; without removing the nozzle from the body of the bottle, filling the dropper bottle with the solution via a fill valve located on the bottom of the bottle; and sealing the dropper bottle by securing a cap to the dropper bottle. The method according to another embodiment can include providing an empty and sterile dropper bottle; providing a solution to be transferred to the dropper bottle; without removing the nozzle from the body of the bottle, filling the dropper bottle with the solution via a liquid pathway located on the nozzle of the bottle; and sealing the dropper bottle by securing a cap to the dropper bottle.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
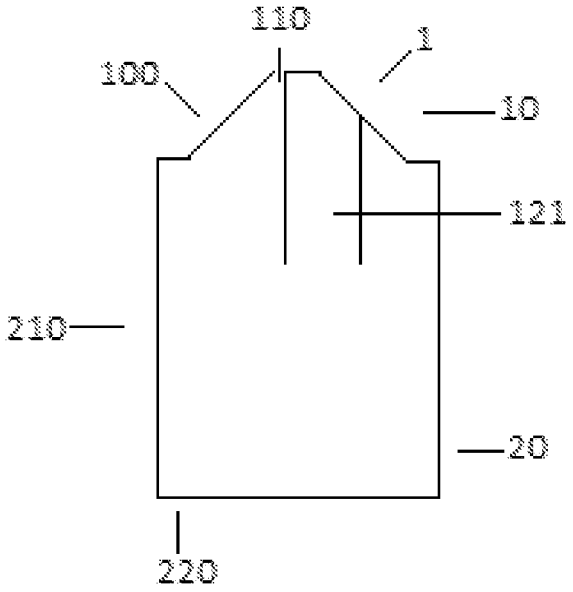
FIG. 1 is a cross section of a bottle according to one embodiment of the present invention.

FIG. 1 is a cross section of a bottle 1 according to one embodiment of the present invention. As discussed, the invention is designed to permit the filling of bottles having an integrated nozzle 100 and body 210. Therefore, the drawings depict a unitary design. However, it should be appreciated that the present invention is not limited merely to unitary bottles, and that the features of the present invention may also be employed with more traditional dropper bottle configurations wherein the nozzle 100 and body 210 are separate, but are delivered to a compounder in a pre-assembled configuration to preserve sterility inside the bottle.

Figure 2:
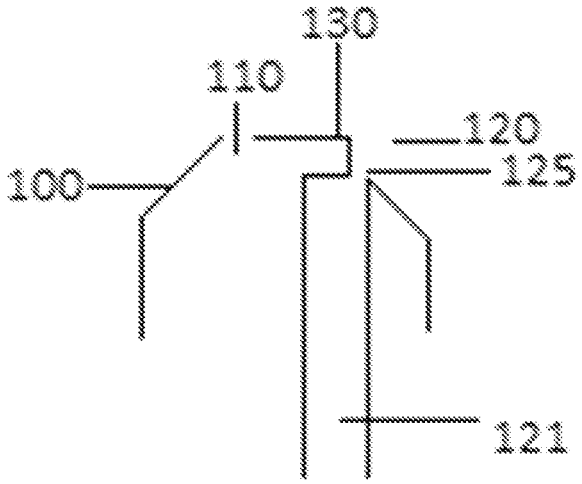
FIG. 2 is a cross section of a top end of a bottle according to one embodiment of the present invention.

The bottle 1 of FIG. 1 is designed to be filled through the nozzle 100. In particular, the bottle 1 includes a top end 10 having a nozzle 100. The nozzle includes both a liquid pathway 110 and vent 120. The vent 120 is segregated from the liquid pathway 110 and is instead disposed in communication with a vent tube 121 that runs at least partially into the body 210 of the bottom end 20. In this regard, any of a variety of filling apparatus can be applied to the nozzle 100 without regard to the specific orientation of the liquid pathway 110 compared to the vent 120, because any liquid will be automatically diverted into the liquid pathway 110. FIG. 2 is a detail view of one embodiment in which the air outlet 125 of the vent is disposed on the side of the nozzle 100 wherein the shield 130 can be seen extending in at least partially covering orientation over the air outlet 125.

Figure 3:
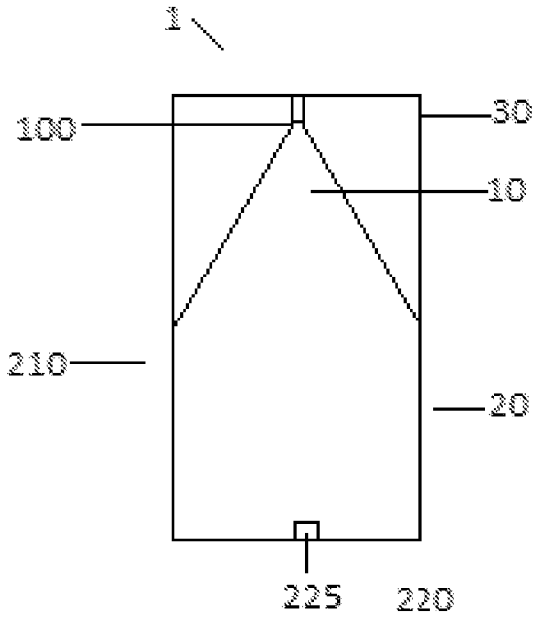
FIG. 3 is a cross section of a bottle according to another embodiment of the present invention.
Figure 4:
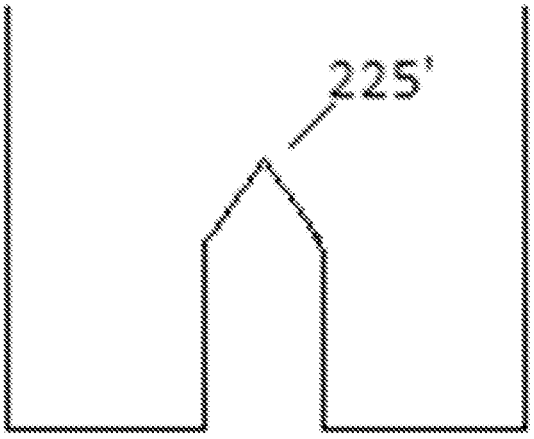
FIG. 4 is a cross section of a base of a bottle according to another embodiment of the present invention.

FIG. 3 is a cutaway view of a bottle 1 according to yet another embodiment of the present invention in which the bottle 1 may be filled from the base 220. In such an embodiment, the base 220 may include a fill valve 225 which may comprise any of a variety of configurations. In a preferred embodiment, the fill valve 225 may comprise a one-way valve. As a non-limiting example, FIG. 4 depicts a duck bill valve 225' in which two opposing elastomeric surfaces meet at an oblique angle. When fluid is directed through the duck bill valve 225' from the exterior of the bottle, the surfaces are forced apart and liquid is permitted to flow through the valve. When fluid is forced from the interior of the bottle, however, the surfaces are forced together, and no fluid is permitted through.

Figure 5:
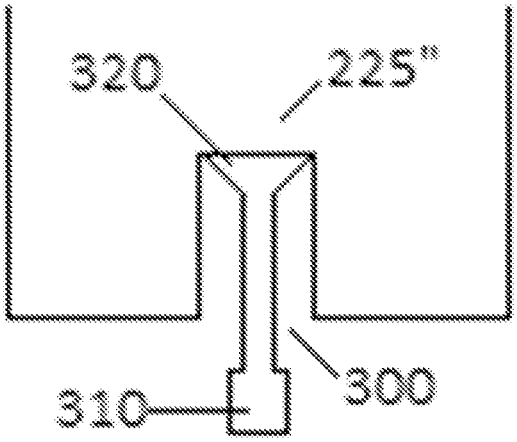
FIG. 5 is a cross section of a base of a bottle according to yet another embodiment of the present invention.

As another non-limiting example, FIG. 5 shows a fill valve 225" having a configuration of a plug 300 which may be used to manually seal an aperture in the bottom end of the bottle after filling. In particular, the plug 300 includes a sealing end 320 inside the bottle and a tab 310 protruding exteriorly of the bottle. When in a free-floating orientation, the sealing end is not disposed directly against the aperture in the bottom of the bottle, and the plug 300 will permit fluid to flow into the bottle. However, a user may grasp the tab 310 and pull the plug 300 into a sealing configuration, in which the aperture is sealed. The plug 300 may include a gasket or pressure activated adhesive on the sealing end 320 to ensure a substantially water tight seal.

FIG. 3 also depicts a cap 30 installed on the bottle 1. In a preferred embodiment, the bottle 1 is provided to a compounder with the cap 30 in a partially installed orientation. This ensures that the cap 30 is not air-tight prior to filling such that the bottle 1 can be vented during filling. However, the partial installation of the cap 30 also helps ensure that the interior of the bottle 1 maintains a sterile environment. Once the bottle 1 is filled, the compounder can complete the installation of the cap 30, such as by making a quarter turn of the cap 30.

It will be recognized that a variety of fittings and connections may be employed depending upon the particular use case envisioned. In certain cases, pharmaceutical compounding is conducted in very small batches. In this case, the user may conveniently fill one or a small number of bottles from a syringe. As such, a luer fitting on the fill valve 225 may be appropriate. Otherwise, for somewhat larger batches, it is known that the various repeater pumps used by compounders may have other fittings, and the fill valve 225 can be configured to fit any of a number of widely available pumps.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A dropper bottle comprising:

a top end and a bottom end;

a nozzle at said top end;

a fill valve located at said bottom end, said fill valve comprising a plug disposed interiorly of the dropper bottle, said plug including a tab extending exteriorly of the dropper bottle, said plug disposed in a free-floating orientation concurrent to fluid low into the dropper bottle, and said plug manually pulled from said free-floating disposition, via said tab, into a sealing configuration with said bottom end, subsequent to said fluid flow.

2. A dropper bottle comprising;

a top end and a bottom end a nozzle connected to said top end and including a plurality of fluid pathways;

at least a first of said plurality of fluid pathways comprising a liquid path for at least dispensing medication from said dropper bottle;

at least a second of said plurality of fluid pathways comprising a vent, said vent including an air outlet disposed on said nozzle for air escape when filling said dropper bottle, a shield connected to said nozzle and extending outwardly therefrom in at least partially covering relation to said air outlet, a fill valve located at said bottom end and comprising a plug disposed interiorly of the dropper bottle, said plug including a tab extending exteriorly of the dropper bottle, said plug disposed in a free-floating orientation concurrent to fluid low into the dropper bottle, and said plug manually pulled from said free-floating disposition, via said tab, into a sealing configuration with said bottom end, subsequent to said fluid flow.

3. The dropper bottle as recited in claim 2 wherein said first pathway is segregated from said second pathway.

4. The dropper bottle as recited in claim 2 wherein said vent is disposed in communication with a vent tube.

5. The dropper bottle as recited in claim 4 wherein said vent tube extends at least partially into said bottom end.

* * * * *